US007298080B2

(12) United States Patent
Kodera et al.

(10) Patent No.: US 7,298,080 B2
(45) Date of Patent: Nov. 20, 2007

(54) DISPLAY DEVICE

(75) Inventors: Yoshie Kodera, Chigasaki (JP); Masakazu Sagawa, Inagi (JP); Toshiaki Kusunoki, Tokorozawa (JP); Tetsu Ohishi, Hiratsuka (JP); Yuichi Sawai, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 494 days.

(21) Appl. No.: 10/929,602

(22) Filed: Aug. 31, 2004

(65) Prior Publication Data

US 2005/0093421 A1 May 5, 2005

(30) Foreign Application Priority Data

Oct. 15, 2003 (JP) ..... 2003-354490

(51) Int. Cl.
*H01J 63/04* (2006.01)
*H01J 1/62* (2006.01)

(52) U.S. Cl. ..... 313/495; 313/496; 313/497

(58) Field of Classification Search ..... 313/495–497, 313/293–304, 309, 310, 336, 346 R
See application file for complete search history.

(56) References Cited

U.S. PATENT DOCUMENTS 5,477,105 A * 12/1995 Curtin et al. ..... 313/422
5,650,690 A * 7/1997 Haven ..... 313/422
6,653,777 B1 * 11/2003 Onishi ..... 313/495
2002/0013113 A1 * 1/2002 Onishi et al. ..... 445/6

FOREIGN PATENT DOCUMENTS

JP 07-282743 10/1995
JP 2001-101965 4/2001

* cited by examiner

*Primary Examiner*—Mariceli Santiago
*Assistant Examiner*—Anne M Hines
(74) *Attorney, Agent, or Firm*—Antonelli, Terry, Stout & Kraus, LLP.

(57) ABSTRACT

A flat type display device is provided which is capable of accurately and easily assembling a spacer when arranging the spacer while reducing the danger of damaging the metal back. In the display device, a plurality of fine holes each having a fluorescent materials are formed on a light transparency substrate and a metal sheet is arranged by a black oxide film formed on the surface of the light transparency substrate side so as to obtain a light absorbing layer. A plurality of concave portions are provided on a surface of the metal sheet of the rear substrate side. A metal back having an openings corresponding to predetermined areas containing each of the concave portions is superimposed on the metal sheet, thereby constituting an acceleration electrode of two-layer structure. The spacer is inserted into the concave portion on the metal sheet exposed in the opening of the metal back.

12 Claims, 6 Drawing Sheets

DISPLAY DEVICE

INCORPORATION BY REFERENCE

This application claims priority from Japanese application JP2003-354490 filed on Oct. 15, 2003, the content of which is hereby incorporated by reference into this application.

BACKGROUND OF THE INVENTION

This invention relates to a display device such as a field emission display (hereinafter, referred to as FED) containing in an air tight vessel an electronic source formed of electronic emission elements arranged in a matrix.

The FED constitutes an air tight vessel by opposing a rear panel where electronic emission elements are arranged in a matrix and a display panel including a light transparent substrate having fluorescent materials of three primary colors (R, G, B) which emit light by collision of electrons from the electron emission elements. Since inside the air tight vessel, a vacuum atmosphere is present, in order that the vacuum vessel is not destroyed by the pressure difference between the inside and the outside, a plurality of support members (hereinafter, referred to as spacers) are arranged between the display panel and the rear panel. On the other hand, a conductive thin film called metal back is formed on the rear panel side of the fluorescent materials formed on the light transparent substrate to which acceleration voltage (anode voltage) for accelerating the electrons from the electron emission elements is applied. Such an FED configuration is disclosed, for example, in JP-A-2001-101965 (document 1), FIG. 21.

In the afore-mentioned FED configuration, when arranging the spacers, the metal back may be peeled off by the interference (physical contact) between the spacers and the metal back. The conventional technique for preventing this is disclosed, for example, in JP-A-7-282743 (document 2), FIG. 4, FIG. 6 and FIG. 7. According to this disclosure, on the areas where spacers are to be arranged, metal back is removed to expose the black stripes (black light absorbing layer) arranged between the fluorescent materials, so that the spacers are fixed on the black stripes.

SUMMARY OF THE INVENTION

The metal back which has been peeled off by the interference between the spacers and the metal back (spacer positioning shift and spacer deformation) is scattered to the electron emission elements, wiring circuit and the like and there is a danger of short-circuiting them. The afore-mentioned document 2 discloses a technique that the spacers are not in direct contact with the metal back, thereby preventing the short-circuiting due to the interference between the spacers and the metal back.

When the spacers are charged, an orbit of electrons from the electron emission element is changed and the electron does not collide into the fluorescent material preferably. Accordingly, it is necessary to prevent or reduce charging of spacers by electrically contacting the spacers with the metal back. In the document 1, the light absorbing layer where the spacers are fixed is made from an insulative material such as graphite or black color glass (see the document 1, paragraph 0030). For this, in order to prevent charging of the spacers, the spacers are electrically connected to the metal back with a conductive layer or a conductive flit glass, thereby assuring electric conductivity between them.

That is, the document 2 discloses a technique to prevent interference between the spacers and metal back but in addition to the step of fixing the spacers onto the light absorbing layer, a new step of connecting spacers to the metal back is required. That is, two independent steps are required: a step of fixing spacers to the light absorbing layer and the step of electrically connecting the spacers to the metal back, thereby complicating the manufacturing procedure.

Moreover, it is difficult to accurately arrange in the light absorbing layer area of about 100 μm wide. FIG. 8 shows an example of arrangement (partial) of fluorescent materials in a flat-type display device having a 30-inch display range, 1280×720 pixels (one pixels consists of a set of R, G, B pixels), and aspect ratio 16:9. As shown in FIG. 8, the fluorescent materials 111R, 111G, 111B are arranged at 0.173 mm pitch in Y direction so as to sandwich the black stripes 150*a* which are the black light absorbing layers of width of 0.05 mm. Moreover, the fluorescent materials 111R, 111G, and 111B are separated in X direction by black stripes 150*b* which are black light absorbing layers of about 0.1 mm wide. In order to prevent spacers from affecting the image, the spacers should be positioned in the light absorbing layers and should be 100 μm or below of the width of the black stripes 150*b*. Furthermore, considering the spacer attachment error and spacer thickness direction manufacturing error, the spacer thickness should be substantially 90 μm. It is difficult to arrange and position a flat spacer having a thickness of about 90 μm or below along the area of the narrow light absorbing layer having a width of about 100 μm, when clearance in the thickness direction is considered. Additionally, there is a danger that the spacer side wall may scratch the metal back.

Accordingly, in the FED, when arranging spacers on the display panel, it is necessary to prevent charging of the spacers, assemble the spacers accurately in one step, and reduce the danger of damaging the metal back. When this is achieved, it is possible to improve the reliability of the flat-type display device such as the FED. Furthermore, this can improve the productivity of the display device.

It is therefore an object of this invention to provide a display device having an improved reliability.

In order to achieve the afore-mentioned object, the display device according to this invention includes a conductive sheet (hereinafter, referred to a metal sheet) having a plurality of holding holes (hereinafter, referred to as fine holes) formed in a matrix for containing and holding a plurality of fluorescent materials on a surface of the light transparent substrate of the rear panel side and a metal back arranged on the surface of the metal sheet of the rear panel side so as to be brought into electrical contact with the conductive sheet. An opening is formed at an area opposing to an area between fine holes of the conductive sheet and a spacer is attached to the metal sheet exposed from this opening.

With the configuration, the spacer is attached to the metal sheet in the opening where the metal back is removed. Thus, the spacer can be attached without interfering (direct contact) with the metal back and it is possible to prevent peeling off of the metal back. Furthermore, the spacer is attached to the metal sheet which is electrical contact with the metal back and it is possible to apply a small current from the metal back via the metal sheet to the spacer. Accordingly, without electrically connecting the spacer to the metal back (without performing a new work for this), it is possible to prevent charging of the spacer.

Moreover, in an aspect of this invention, a concave portion is provided in the metal sheet for inserting the spacer and the spacer is inserted into the concave portion exposed from the opening of the metal back. Thus, while preventing the interference with the metal back, it is possible to accurately and easily assemble the spacer with one connection by using the concave portion, thereby improving the productivity.

Moreover, according to this invention, the surface of the metal sheet of the light transparent substrate side is made substantially black to form a light absorbing layer. In this invention, the spacer is arranged between the fine holes of the metal sheet, i.e., on the area of the light absorbing layer. Accordingly, the spacer does not affect the image.

Other objects, features and advantages of the invention will become apparent from the following description of the embodiments of the invention taken in conjunction with the accompanying drawings.

DETAILED DESCRIPTION OF THE EMBODIMENTS

Description will now be directed to a flat-type display device according to the embodiments of this invention with reference to the attached drawings. The flat-type display device according to this invention includes: a rear panel (first panel) where a plurality of cold cathode elements are arranged as electron emission elements; a display panel (second panel) having a light transparent substrate arranged to oppose to the rear panel; and spacers for supporting the rear panel and the display panel. Furthermore, the display device according to this invention includes: a conductive sheet on which a plurality of holding holes are formed in a matrix shape for holding a plurality of fluorescent materials corresponding to the plurality of cold cathode elements; and a metal back arranged on the rear panel side of the conductive sheet (metal sheet) in such a manner that it is in electric contact with the metal sheet, to which metal back acceleration electrode is applied for accelerating the electrons emitted from the cold cathode elements. Openings are formed on the metal back at the area opposing to the area between the plurality of holding holes in the metal sheet, so that the spacers are brought into abutment with the conductive sheet exposed from the openings of the metal back. Thus, it is possible to support the display panel and the rear panel by the spacers while preventing interference with the metal back. The flat-type display device according to this invention is characterized by the afore-mentioned configuration. Moreover, this invention is characterized in that concave portions are formed at predetermined positions between the plurality of fine holes for holding the spacers and the spacers are inserted into the concave portions so as to support the rear panel and the display panel. Hereinafter, the characteristic will be detailed.

Figure 1:
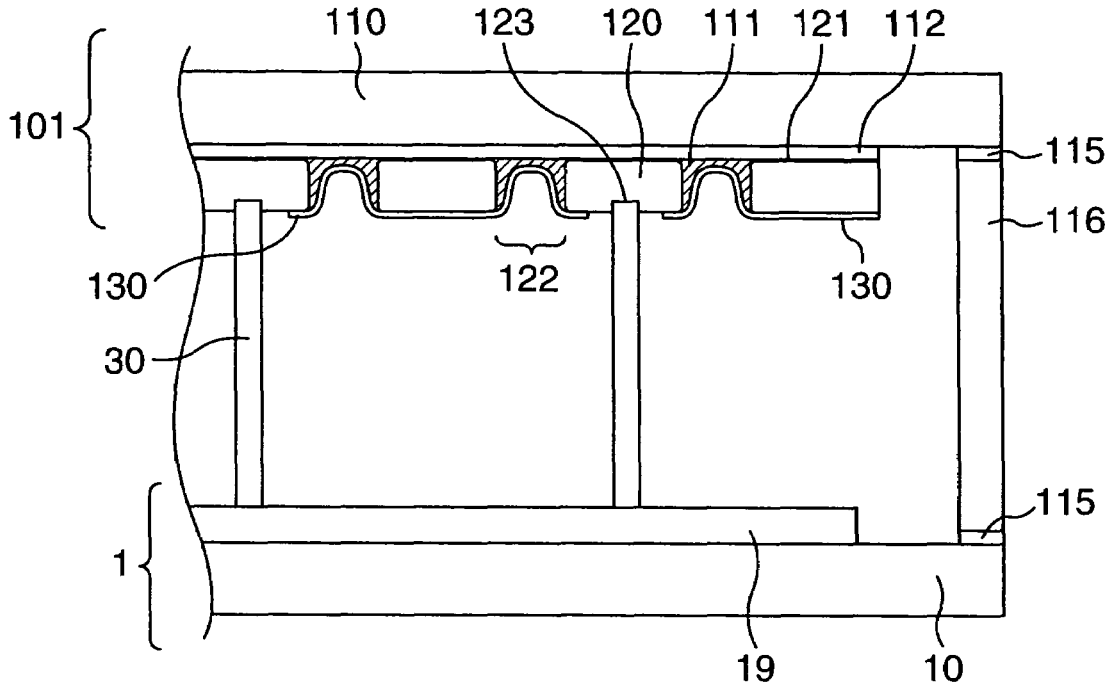
FIG. 1 shows a brief configuration of a flat-type display device according to a first embodiment of this invention.

Firstly, explanation will be given on a first embodiment. FIG. 1 shows a brief configuration of the float-type display device according to the first embodiment of this invention. In FIG. 1, a display panel 101 includes: a light transparent substrate 110 such as glass transmitting light; a thin metal sheet 120 having a plenty of fine holes 122 arranged in a matrix shape (two-dimensional state); a fixation layer 112 having a low melting point for fixing the metal sheet 120 onto the light transparent substrate 110; fluorescent material 111 applied inside the fine holes 122 of the metal sheet 120; and a metal back 130 made of metal (such as aluminum (Al)) formed on the metal sheet 120.

The metal sheet 120 is configured similarly as the shadow mask used in the Braun tube (CRT). That is, the metal sheet 120 has a plenty of fine holes 120 formed in a matrix shape and the fluorescent material 111 is painted to each of the fine holes 122. That is, the fine holes 122 are used as holes for holding the fluorescent material 111. Moreover, the metal sheet 120 has a surface of the light transparent substrate 110 side as a light absorbing layer 121 of substantially black color preventing reflection of the outer light and preventing lowering of contrast. Furthermore, the metal sheet 120 has the other surface of the rear panel 1 side where concave portions 123 are formed at predetermined positions between the plurality of fine holes 122. The concave portions 123 are indentations or grooves for inserting spacers 30. As has been described above, the spacers 30 are arranged vertically between the rear panel 1 and the display panel 101 and support the rear panel 1 and the display panel 101 so as to support the interval between them. The spacers 30 are inserted into the concave portions 123, for example, via flit glass (not depicted) and fixed there.

To the metal back 130, acceleration voltage (anode voltage) is applied for accelerating electrons from the cold cathode elements toward the fluorescent material 111. The metal back is formed at the rear panel 1 side of the metal sheet 120 excluding the concave portions 123 where the spacers 30 are inserted and a predetermined area in the vicinity of the spacers. That is, the metal back 130 has a plurality of openings 131 including concave portions 123 in the openings. Explanation will be given on why the concave portions where the spacers 30 are inserted and a predetermined area in the vicinity of the spacers are made as openings 131 and metal back is not provided. In case metal back is formed on the concave portion 123, when inserting the spacers 30 into the concave portion 123, the spacers 30 and the metal back interfere each other and the spacers 30 scratches the metal back. Then, the metal back is peeled off and its fine powder is scattered, which may short-circuit the electron emission element on the rear panel 1. In order to prevent this, no metal back is provided at predetermined area including the concave portion 123 where the spacer 30 is arranged. Moreover, the metal back 30 is electrically connected to the metal sheet 120 and the spacer 30 is electrically connected to the metal back 130 via the metal sheet 1120. Furthermore, the metal back 130 has the function to protect the fluorescent material from deterioration by electron beam irradiation, the function to reflect the light directed toward the rear panel 1 side among the light emission of the fluorescent material against the light transparent substrate 110, thereby improving light emission luminance, and the function to conduct charge of the fluorescent material and prevent charging of the fluorescent material.

The method for forming the metal back is detailed, for example, in JP-A-5-36355. Here, only brief explanation will be given on this. Firstly, on the fluorescent material 111, for example, a filming film of organic film is formed by the emulsion method or lacquer method. On the filming film, aluminum is vapor-deposited about 80 to 100 nm thick. After this, baking is performed at 450 degrees C. or above so as to decompose and remove the filming film of the organic film.

The rear panel 1 includes, for example, an insulative substrate 10 composed of glass and an electron emission element formation layer 19 of the cold cathode having a plenty of electron emission elements formed as an electron source on the insulative substrate 10. The electron emission element used is, for example, a so-called MIM type in which an insulator is sandwiched between an upper electrode and a lower electrode. Scan (selection) voltage is applied to the lower electrode constituting the electron emission element while a drive signal from a drive signal generation circuit (not depicted) is applied to the upper electrode. The drive signal is generated by processing a video signal input to tan input section (not depicted) and the level is changed according to the intensity of the video signal. When the scan is applied to the lower electrode and the drive voltage is applied to the upper electrode, an electron appears according to the potential difference. The electron is pulled by the acceleration electrode applied to the metal back 130 and collides into the fluorescent material 111.

In the flat-type display device, the display panel 101 and the rear panel 1 are supported by the spacers 30 and the periphery of the display panel 101 and the rear panel 1 is air-tightly attached by using flit glass 115. The pressure inside is about $10^{-5}$ to $10^{-7}$ torr.

As has been described above, the metal sheet 120 is configured in the same way as the shadow mask used as a color selection mask for irradiating an electron beam to a predetermined fluorescent material in the cathode ray tube (CRT) for a color television. Firstly, in an extremely low carbon steel thin plate of an Fe—Ni-based alloy, a plenty of fine hold 122 are formed in a matrix shape by etching. At temperature of 450 to 470 degrees C. which is equal to or lower than the steel re-crystallization temperature, thermal treatment is performed in a oxidization atmosphere for 10 to 20 minutes so that the surface becomes black. Thus, when producing the metal sheet, the conventional facility for producing the shadow mask can be used as it is.

The thickness of the metal sheet 120 is about 20 to 250 μm. The lower limit of the thickness is decided as this because almost no commercial demand is present for a steel plate having a thickness lower than this and as will be detailed later, the layer of the fluorescent material 111 is about 10 to 20 μm, which should be exceeded. Moreover, the extremely low carbon steel thin plate of Fe—Ni-based alloy is expensive and the upper limit is preferably 250 μm because little commercial demand is present for the thickness exceeding this.

The fluorescent material 111 in the fine holes 122 is excited by the electronic beam from the electron emission elements on the rear panel 1 and the secondary electron generated from the fluorescent material may leak into the adjacent fine hole 122 to excite the fluorescent material there and emit light. In order to prevent this, in this embodiment, the height of the fine hole 122, that is, the thickness of the metal sheet is greater than the thickness of the fluorescent material. Thus, the secondary electron generated is absorbed by the inner wall of the fine hole 122 (the black oxide film of the inner wall is removed and the inner wall conducts electricity, which will be detailed later) and the metal back 130 and not leak into the adjacent fine hole 122. Accordingly, it is possible to reduce the charge of the fluorescent material.

Since the surface of the metal sheet 120 is subjected to blackening processing and black oxide film is formed on the surface, the surface of the light transparent substrate 110 side can be used as the light absorbing layer 121. On the other hand, since the inner surface of the fine hole 122 and the black oxide film of surface of the rear panel 1 side remove electric charge from the fluorescent material and gives conductivity with the metal back, they are removed, for example by the sand blast. Thus, the inner surface of the fine hole 122 and the surface of the rear panel 1 side conduct electricity.

Accordingly, the metal sheet 120 is electrically connected with the metal back 130 formed on it and the acceleration voltage applied to the metal back is also applied inevitably to the metal sheet 120. That is, the acceleration electrode (not depicted) for accelerating electrons emitted from the rear panel 1 has the two-layer structure consisting of the metal sheet 120 and the metal back 130 arranged on it.

On the other hand, the spacers 30 are emitted by the electrons from the electron emission elements and in the vicinity of the spacers 30, the orbit of electrons emitted from the rear panel 1 is curved and there arises a phenomenon that the image is distorted. In order to prevent this, as is disclosed in JP-A-57-118355 and JP-A-61-124031, it is necessary to apply small current to the spacer surface by providing on the spacer surface a film of tin oxide having a high resistance, or mixed thin film of tin oxide and indium oxide, or a conductive film of a metal film.

In this invention, the spacers are arranged in the concave portions 123 where no metal back of the metal sheet 120 is formed but the afore-mentioned acceleration voltage is applied to the metal sheet 120. Accordingly, it is possible to apply a small current from the metal back 130 to the spacers 30 via the metal sheet 120.

The metal sheet 120 thus processed is fixed to the light transparent substrate 110 by a fixing layer 112 of a low melting point (500 degrees C. or below). The fixing member of the fixing layer 112 is, for example, flit glass which is a glass having a low melting point. The flit glass is applied to the light transparent substrate 110, to which the metal sheet 120 is attached. This is subjected to thermal treatment with 450 to 470 degrees for sintering. The fixing member may also be polycylazan which is liquid glass precursor. By using this, sintering and fixing may be made with a temperature of more than 120° C.

It should be noted that the optical characteristic of the fixing layer is not limited to the light transparency of about 100%. For example, in the CRT, a glass whose transparency is limited to a predetermined value is conventionally used as the front panel material so as to improve the contrast. Accordingly, in this invention also, even though the light transparent substrate is transparent (light transparency is almost 100%), the fixing layer can be formed by a glass layer whose light transparency is limited to a predetermined value, so as to obtain the effect of contrast improvement like in the CRT. The glass whose transparency is limited can easily be manufactured in the same way as the one used in the CRT conventionally.

The metal sheet 120 is fixed to the light transparent substrate 110 via the fixing layer 112. For this, in order to reduce the thermal distortion caused by difference in thermal expansion between the metal sheet 120 and the light transparent substrate 110, the metal sheet 1120 preferably has the same coefficient of thermal expansion as the light transparent substrate 110. When glass is used as the light transparent substrate 110, the coefficient of thermal expansion of the glass is about 38 to $90\times10^{-7}$/degrees C. (30-300 degrees C.). The coefficient of thermal expansion of the metal sheet 120 made of an Fe—Ni-based alloy can be made the same by changing the content of nickel (Ni). For example, when the light transparent substrate 110 is made of boron-silicated glass having a coefficient of thermal expansion $48\times10^{-7}$/degrees C. and the metal sheet 120 is made of an Fe-42% Ni alloy, for example, their thermal expansions may be made substantially same.

From the same point of view, the fixing layer 112 also preferably has the same coefficient of thermal expansion as the light transparent substrate 110. For this, the fixing member is made of, for example, flit glass having the same coefficient of the thermal expansion as the light transparent substrate made of the glass material.

It should be noted that it is preferable that the metal sheet 120 have the same coefficient of thermal expansion as the light transparent substrate 110 so as to reduce the thermal distortion but the light transparent substrate made of glass and the fixing layer have weak tensile stress. For this, the coefficient of thermal expansion of the metal sheet 120 may be slightly greater than that of the light transparent substrate 110 and the fixing layer 112, so that compressive stress is applied to the light transparent substrate and the fixing layer when actually used.

Here, according to the afore-mentioned embodiment, the metal sheet 120 has a plenty of fine holes, a surface is subjected blackening processing, and it is fixed to the light transparent substrate 110 by the after-fixing layer. However, the invention is not limited to this process. For example, the metal sheet may be subjected in an oxidization atmosphere and the surface is subjected to blackening processing in advance. The metal sheet is fixed to the light transparent substrate by the fixing layer, after which a plenty of fine holes are formed by etching. By this process, the same function as the afore-mentioned embodiment can be obtained and since fines holes are absent when fixing the metal sheet 120 to the light transparent substrate, handling becomes easy and fixation efficiency is improved.

After the metal sheet 120 is fixed to the light transparent substrate 110 by the fixing layer 112 which is a glass layer, fluorescent materials 111R, 111G and 111B of red color (R), green color (G) and blue color (B) are pained in the fine holes 122 by about 10 to 20 μm. Filming is performed on it. After this, the metal back 130 is used by using a metal mask by performing vacuum deposition of aluminum by 30-200 nm. The metal back 130 should sufficiently pass electrons from the electron emission elements so that electrons collide into the fluorescent material 111. From this view-point, the metal back has a thickness set within the afore-mentioned range and preferably substantially 100 nm.

Moreover, as has been described above, from the inside of the fine holes 122 of the metal sheet 120 and the rear panel side of the metal sheet 120, the insulative black oxide film is removed by sand blast, for example. For this, electric charge charged to the fluorescent material 111 and secondary electrons generated in the fluorescent material move to the metal sheet 120 and the metal back 114, thereby preventing charging of the fluorescent material.

Furthermore, the metal sheet 120 has a thickness of 20 μm or above which is greater than the thickness of the fluorescent material 111 and fine jaggy is formed on the inner surface of the fine holes 122 by the sand blast. For this, when painting the fluorescent material 111, the fine jaggy provides a preferable wettability and when viewed from the light transparent substrate 110 side, the fluorescent material 111 has a substantially U-shaped form (the bottom is about 100 μm and the side is about 20 μm). Accordingly, the metal back 130 can be preferably formed in the fine holes 122 also, and it is not peeled off easily, i.e., the adhesiveness is improved.

Figure 2:
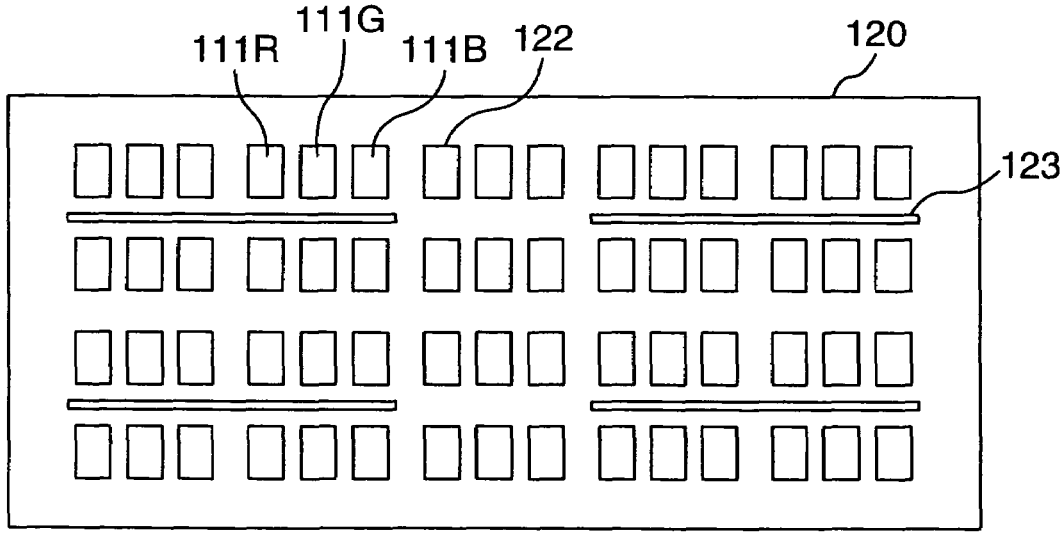
FIG. 2 is a top view of the metal sheet viewed from the rear panel side.

FIG. 2 is a top view of the metal sheet viewed from the rear panel side. Here, for easiness of viewing, the screen consists of 4 lines×5 pixels (each pixel consists of three color pixels: R light, G light, B light) and four concave portions 123 for spacers are depicted. Actually, however, on the entire metal sheet, a plenty of concave portions 123 are provided for arranging a plenty of spacers sufficient to resist the atmosphere.

In FIG. 2, the metal sheet 120 has a plenty of fine holes 122 arranged in a matrix (two-dimensional way). The fluorescent material pained in the fine holes 122 emits light and forms a pixel. FIG. 2 shows an example of the rectangular form of the fine holes. Since fluorescent material is pained inside the fine holes 122, the pixel shape matches with hole shape of the fine holes 122. However, in the same way as the Braun tube, the pixel form, i.e., the form of the fine holes 122 is not limited to this. For example, it may be a circle, ellipse or a rectangle whose four angles are rounded. In each fine hole 122, R fluorescent material 111R, G fluorescent material 111G and B fluorescent material B exist and these three color pixels of fluorescent materials 111R, 111G, 111B form a set of pixels performing color display. A plurality of concave portions 123 are arranged at predetermined positions between the pixels on the surface opposite to the surface where the light absorbing layer is provided.

As is clear from FIG. 1, the concave portion 123 is in the range of the light absorbing layer 121 when viewed from the light transparent substrate 110. Accordingly, when the spacer 30 is inserted and arranged into the concave portion, this will not affect the orbit of the electron beam from the rear panel 1 to the fluorescent material 111. In this invention, the depth of the concave portion 123 is set to substantially ½ of the metal sheet, i.e., about 10 to 125 μm.

Figure 3:
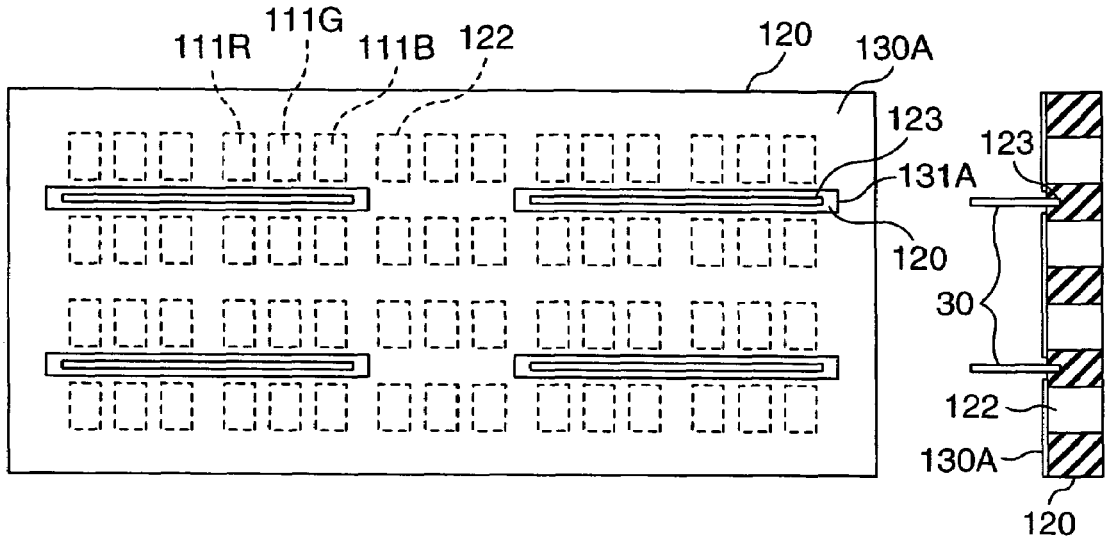
FIG. 3 is a top view of the metal back according to the first embodiment viewed from the rear panel side.

FIG. 3 is a top view of the metal back formed on the metal sheet according to the first embodiment viewed from the rear panel side. In FIG. 3, the metal back 130A is arranged on the metal sheet 1210, but the metal back is not formed in the opening 131A surrounding a predetermined area around the concave portion 123. In the opening 131A, the concave portion 123 and the metal sheet 120 are exposed. That is, the acceleration electrode according to this embodiment has a two-layered structure consisting of the metal sheet 120 having the concave portion 123 and the metal back 130A having the opening 131A and formed thereon. Assembling is facilitated by inserting the spacer 30 into the concave portion 123 in the opening 131A. That is, since the spacer 30 is inserted into the concave portion 123, very small current can be applied to the spacer 30 and prevent changing of the spacer. Moreover, the spacer positioning is easy and the spacer can easily be arranged with a high arrangement accuracy. The arrangement accuracy of the spacer is determined by the formation accuracy of the concave portion 123. The concave portion is formed by etching in the same way as the fine holes. Accordingly, the concave portion can be formed with a high accuracy and the spacer 30 can be arranged at a predetermined position with a high accuracy with respect to the display panel 101. In this invention, the concave portion is not directly connected to the metal back 130A but indirectly, i.e., electrically connected. Unlike the above mentioned document, the connection of the spacer 30 to the display panel can be performed at once. It is noted that the shape of the concave portion 123 is similar to the end surface shape of the spacer 30 inserted.

In FIG. 3, the prolonged rectangular concave portion 123 are arranged in the horizontal direction of the drawing sheet for arranging the flat spacers 30. Since a plurality of spacers are required for resisting against the atmosphere applied to the flat-type display device, a plurality of concave portions 123 are arranged for inserting the spacers. Corresponding to it, the same number of openings 131A are arranged. It is quite natural that the openings and the concave portions may be arranged in the vertical direction of the drawing sheet. It should be noted that the depth of the concave portion 123 is substantially ½ of the metal sheet and the depth is set considering the engagement with the spacer.

As described above, according to this embodiment, the metal back is not formed in the region of the display panel including the portion which is brought into abutment with the spacer 30 (i.e., the concave portion 123 formed on the metal sheet 120). That is, in the metal back according to this embodiment, the portion corresponding to the afore-mentioned region is the opening 131. Accordingly, when arranging the spacer, the spacer 30 does not interfere with the metal back 130 and it is possible to prevent scratching of the metal back by the spacer 30 and scattering of the fine powder. Moreover, even when the spacer 30 scratches the metal sheet 120, the metal sheet 120 is made of an extremely low carbon steel thin plate of Fe—Ni-based alloy and there is no danger of generation of the metal fine powder.

Moreover, since the metal sheet 120 according to this embodiment is an Fe—Ni-based alloy, it has the getter function to react with the oxygen and vapor in the impurities gas emitted from the display panel and the rear panel contained in the FED which is an air tight vessel and to acquire it as oxide. (This will be detailed later). In this embodiment, as described above, the metal sheet 120 is exposed in the opening 131A of the metal back and the exposed surface of the metal sheet 120 acquires oxygen and vapor as impurities gas, thereby maintaining a preferable air tight state in the FED. This effect becomes greater as the area of the exposed surface of the metal sheet 120 increases. Accordingly, as compared to the afore-mentioned first embodiment, the embodiments shown in FIG. 5 and FIG. 6 have a greater effect.

Hereinafter, explanation will be given on the getter function of the Fe—Ni-based alloy. Fe, Ni, Fe—Ni alloy and other metals in general are oxidized in an atmosphere containing oxygen. In other words, they function as the oxygen getter. For example, when the reaction of Equation 1 maintains equilibrium in a closed system, the equilibrium oxygen partial pressure of the system is given by Equation 2. When oxygen exceeding this exists in the system, it reacts with Fe and becomes $Fe_2O_3$ or Fe oxide.

$$\tfrac{4}{3}Fe+O_2=\tfrac{2}{3}Fe_2O_3 \quad \text{(Equation 1)}$$

$$\log P_{O2}=\Delta G^o/RT \ln 10 \quad \text{(Equation 2)}$$

(wherein $\Delta G^o$ is a Gibs free energy change of the reaction)

The equilibrium oxygen partial pressure is a function of temperature. The equilibrium oxygen partial pressure (unit: atmosphere) when the Fe and Fe oxide are in the equilibrium state, for example, at the room temperature is very low as shown in Equation 3.

$$\log P_{O2}=-80 \text{ to } -85 \quad \text{(Equation 3)}$$

Ni also absorbs oxygen of the system by the completely same reason. Accordingly, when the total oxygen amount is sufficiently small in the air tight system, the Fe═Ni-based alloy of the metal spacers are not all oxidized and the Fe—Ni-based alloy function as the oxygen getter. This function in the same way when the system contains vapor. In the reaction of Equation 4, the absolute amount of oxygen maintaining equilibrium with the vapor becomes small and the vapor partial pressure is also lowered.

$$2H_2+O_2=2H_2O \quad \text{(Equation 4)}$$

Figure 7:
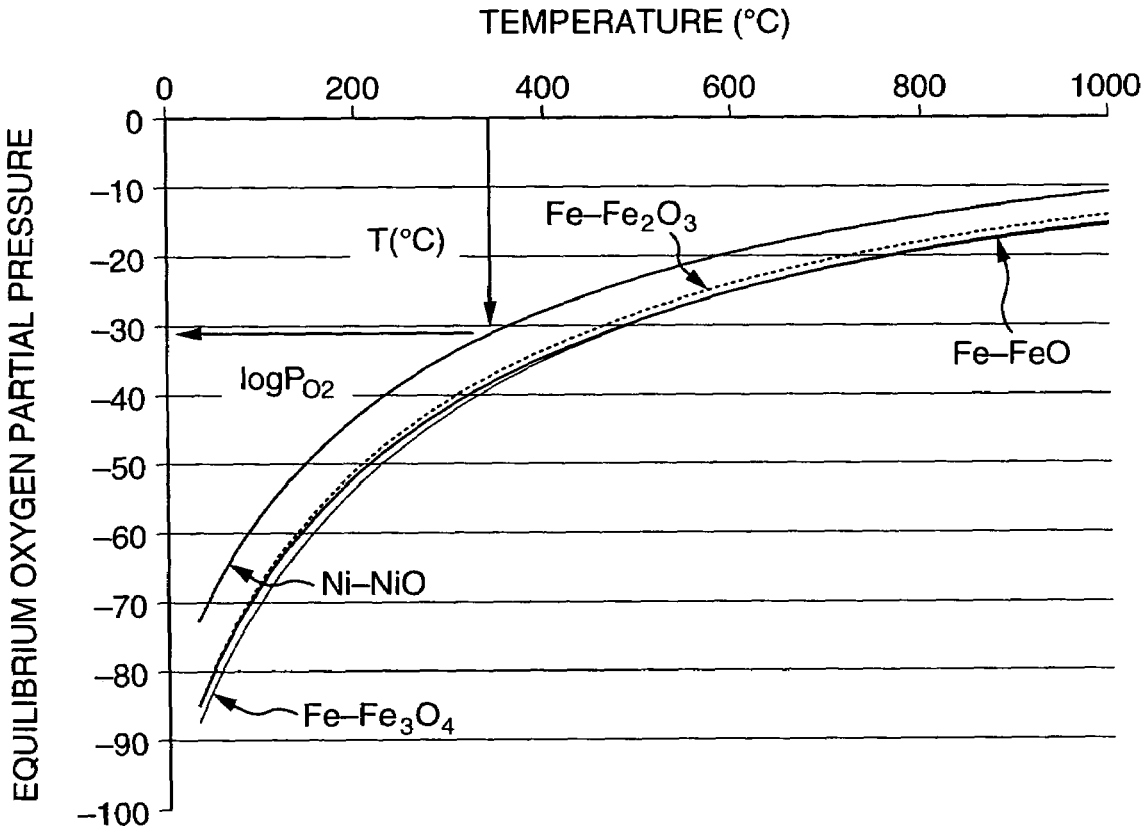
FIG. 7 shows equilibrium oxygen partial pressure when Fe, Ni, and their oxides maintain the state of equilibrium in a closed system.
Figure 8:
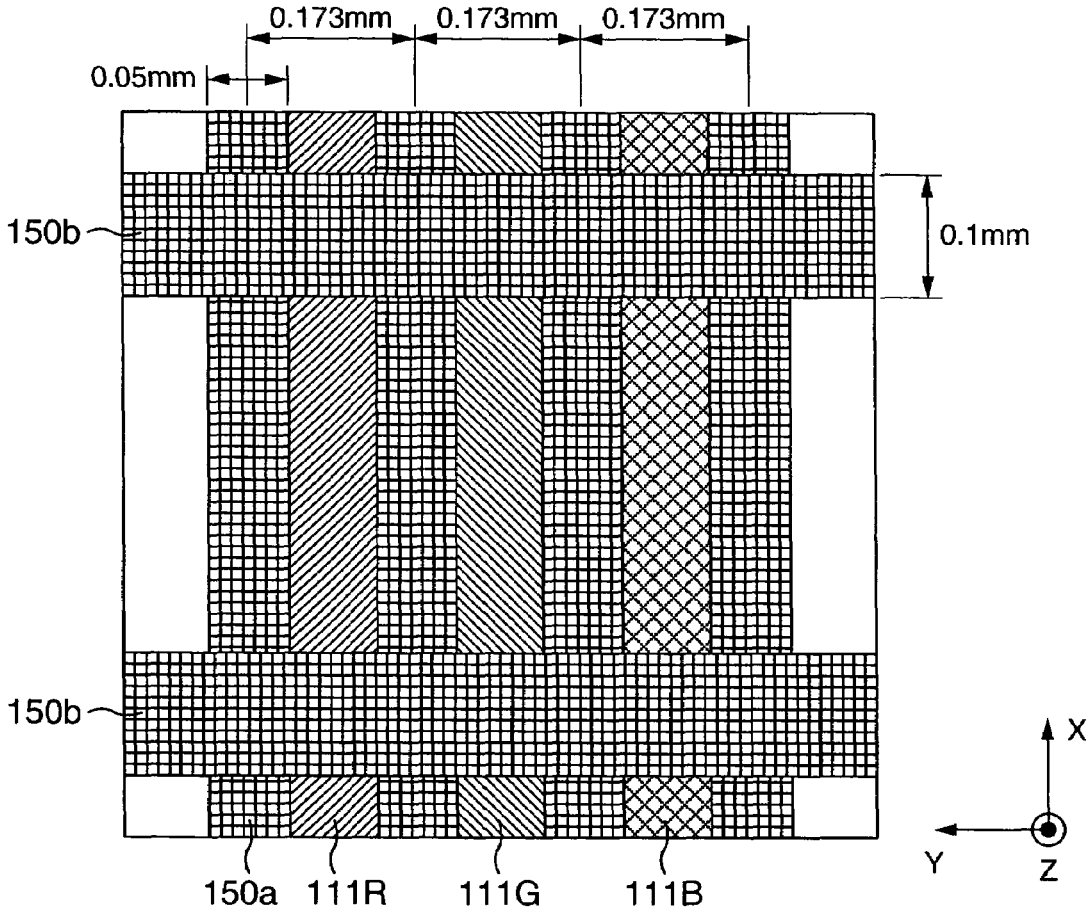
FIG. 8 shows an example of arrangement of fluorescent materials in a flat-type display device.

FIG. 7 shows an equilibrium oxygen partial pressure when Fe, Ni, and their oxides maintain the equilibrium state in the closed system. The equilibrium oxygen partial pressure increase as the temperature increases but it is sufficiently a low value as compared to the oxygen amount in the vacuum part of the FED.

Figure 4:
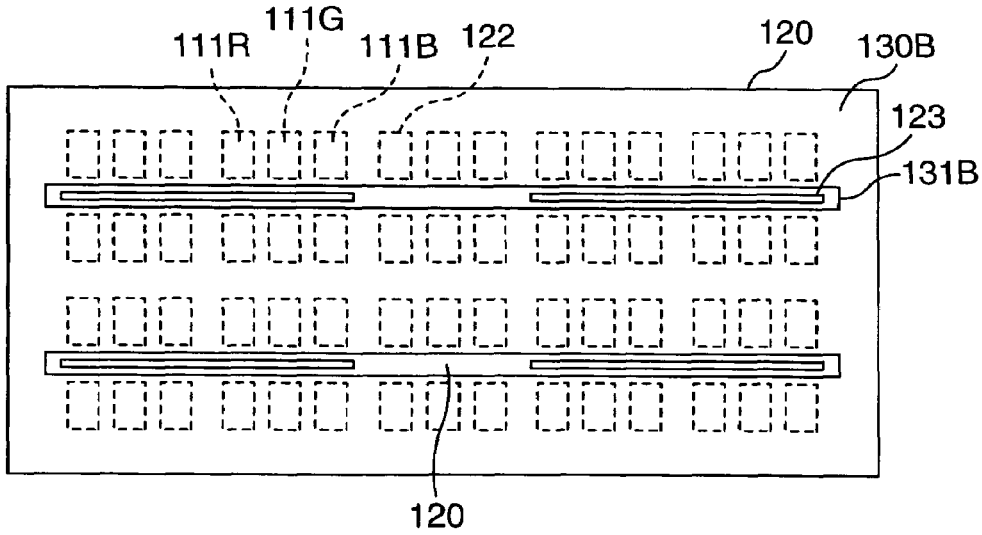
FIG. 4 shows the metal back according to a second embodiment.

As described above, when no metal back is present in the concave portion 123, the spacer 30 inserted into the concave portion 123 does not interfere with the metal back. There are methods for not forming the metal back in the concave portion 123 and the vicinity other than this embodiment. With reference to FIG. 4 and FIG. 6, the other embodiments will be explained.

FIG. 4 shows a metal back according to a second embodiment. In FIG. 4 the metal back 130B has an opening 131B extending in the entire row direction instead of forming openings for each concave portion 123. Like in FIG. 3, no metal back is present in the concave portion 123, the spacer 30 inserted into the concave portion 123 does not interfere with the metal back.

Figure 5A:
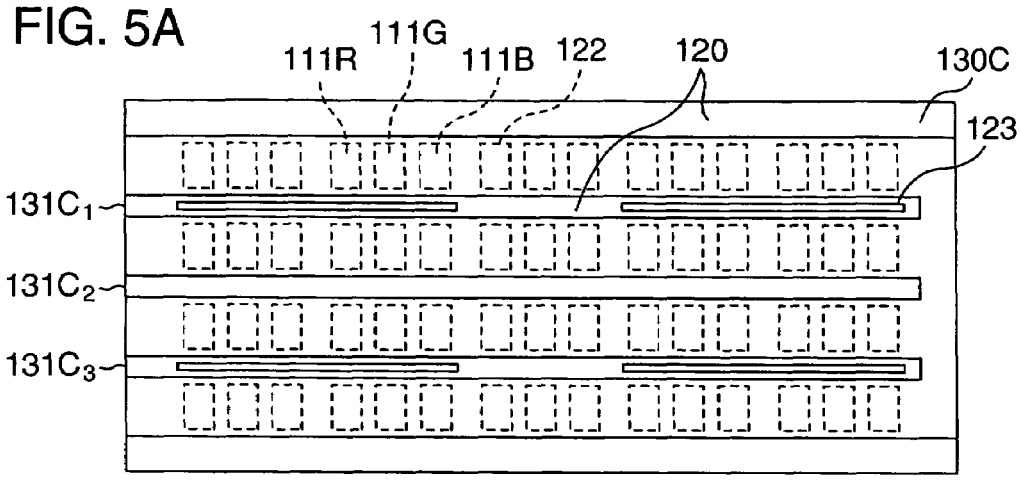
FIG. 5A, FIG. 5B and FIG. 5C show metal backs according to a third, fourth and fifth embodiment.
Figure 5B:
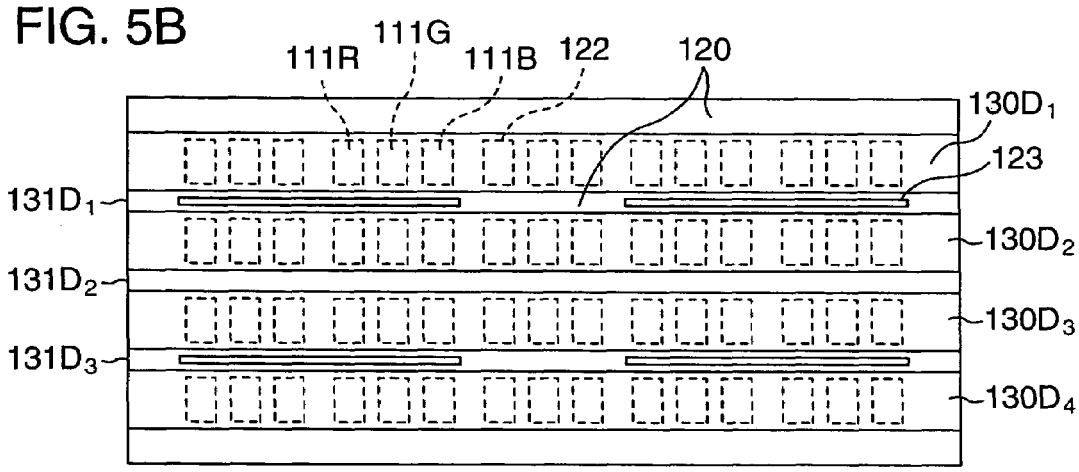
Figure 5C:
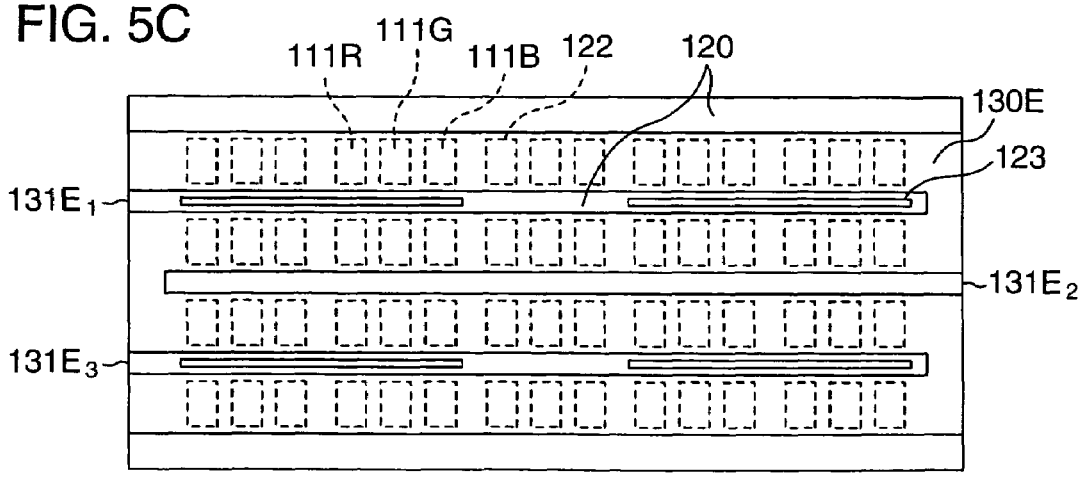

FIG. 5 shows metal backs according to other embodiments. In FIGS. 5A-5C, the metal back is formed on the area where the fluorescent material of the metal sheet is present. FIG. 5A shows a metal back according to a third embodiment. The metal back 130C is formed in a comb-tooth shape on the area where the fluorescent material of the metal sheet 120 is present.

By the way, as described above, the acceleration electrode has a two-layered structure consisting of the metal sheet 120 and the metal back 130 and the resistance is as follows. When the conductivity of copper is assumed to be 100, the aluminum as the material of the metal back 130 has % conductivity 62 while the Fe—Ni-base alloy as the material of the metal sheet has % conductivity as low as 3 (Denki Densi Zairyo Handbook (Electric and electronic material handbook), pp. 597-602, 1987, first edition, Asakura publisher). However, as compared to the metal back 130 having a thickness substantially 100 nm, the metal sheet 120 has thickness as large as 20 μm, i.e., more than 100 times thicker. Accordingly, the area resistance of the metal sheet 120 is smaller than 1/about 4.8 (=300/62) of the metal back 130. Consequently, when the metal back is connected in parallel to the metal sheet, it is possible to reduce the resistance loss of the acceleration voltage. This is approved for DC and low-frequency current.

However, when abnormal emission is caused by some reason, the emission current flows instantaneously. Accordingly, the emission current contains a high-frequency component and it is necessary to consider the skin effect. The high-frequency current flows in the vicinity of conductor surface and not in the center of the conductor. Accordingly, it flows the metal back side having a large % conductivity. Consequently, the emission current which is the high-frequency current flows through the metal back 130 having a thickness of substantially 100 nm and small resistance rather than the metal sheet 120 having a thickness of 20 μm or above and a large high-frequency resistance.

Here, as compared to the metal back in FIG. 3 and FIG. 4 where the metal back is arranged over almost entire range of the metal sheet, the metal back arranged on the area where the fluorescent material of the metal sheet is present as shown in FIG. 5A reduces the width of current flow (width of conductive path), which in turn increases the resistance and inductance. As a result, it is possible to reduce the emission current flowing in the metal back 130 when abnormal emission is caused. Thus, it is possible to minimize damage of electronic emission elements by the excessive current flowing upon abnormal discharge.

It should be noted that the opening 131$C_2$ may not be present. However, in order to minimize damage of the electronic emission elements and the like upon abnormal emission, it is preferable that the opening 131$C_2$ be present.

FIG. 5B shows a fourth embodiment. In FIG. 5B, the metal back 130D is formed only in the area where the fluorescent material of the metal sheet 120 is present. It should be noted that the opening 131$D_2$ may not be present. However, when the reduction of damage of the electron emission elements upon abnormal emission is considered, the opening 131$D_2$ is preferably present.

FIG. 5C shows a fifth embodiment. In FIG. 5C, the metal back 130E is formed continuously, i.e., unicursally only in the area where the fluorescent material of the metal sheet 120 is present. Accordingly, as compared to FIGS. 5A and 5B, the resistance and inductance become greater and it is possible to further reduce damage of the electron emission element or the like upon abnormal emission. It should be noted that the opening 131$E_2$ may not be present. However, when the reduction of damage of the electron emission elements upon abnormal emission is considered, the opening 131$E_2$ is preferably present.

Moreover, like FIG. 3, in FIGS. 5A-5C, no metal back is present in the concave portion 123. Accordingly, even when the spacers 130 are inserted in to the concave portions 123, the spacers 30 to not interfere with the metal back and there is no danger of scattering of the metal back fine powder.

Figure 6A:
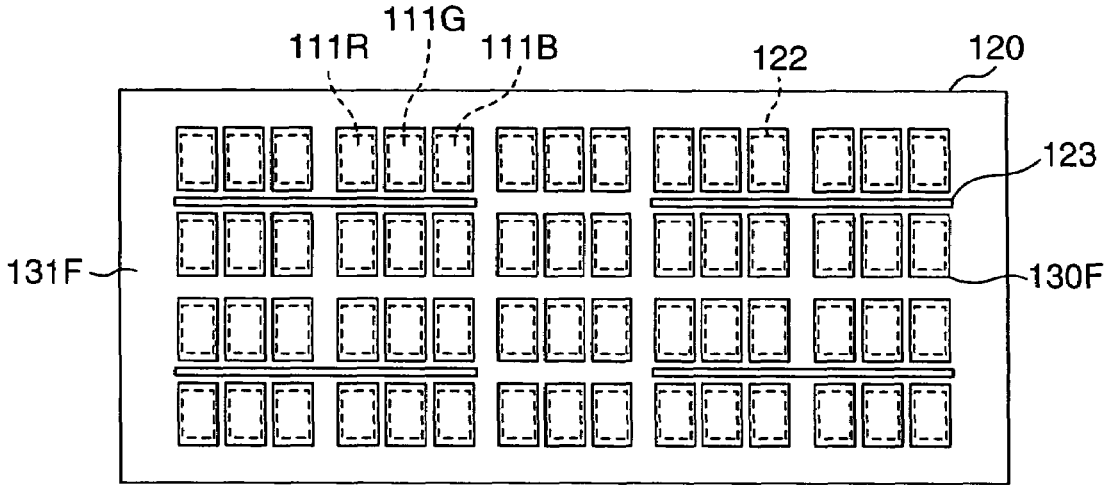
FIG. 6A and FIG. 6B show metal backs according to a sixth and seventh embodiment.
Figure 6B:
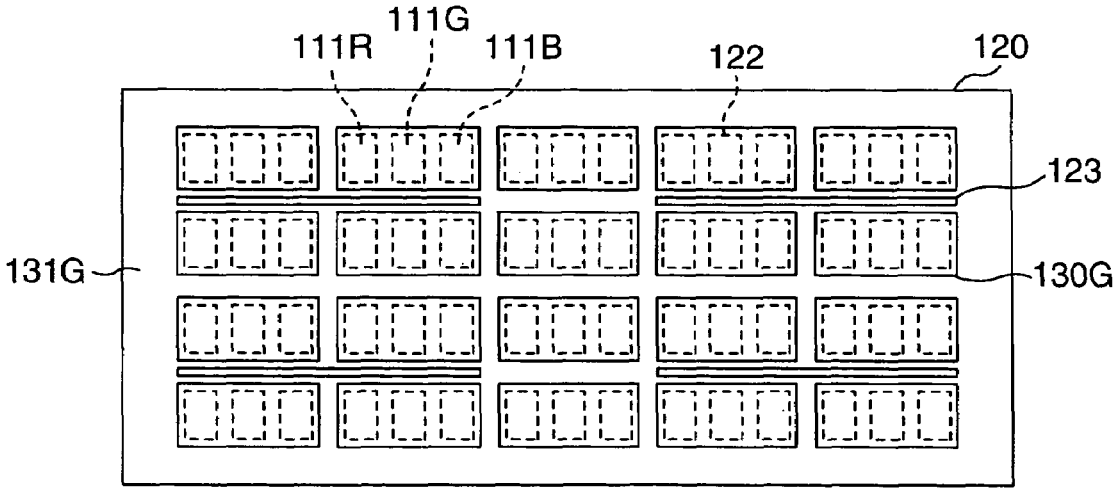

FIGS. 6A and 6B are top views of metal backs according to the other embodiments. In FIGS. 6A and 6B, the metal back is formed in color pixel unit or pixel unit separately. FIG. 6A shows a sixth embodiment in which the metal back 130F is separated in color pixel unit. FIG. 6B shows a seventh embodiment in which the metal back 130G is separated in a set of pixels for performing color display by three color pixels of fluorescent materials 111R, 111G and 111B. Thus, when the metal back is formed separately in color pixel unit or pixel unit, between the metal backs, there exist a plurality of metal sheets whose high-frequency resistance value is high. As a result, it is possible to reduce the emission current upon abnormal emission as compared to the embodiment of FIG. 3 to FIGS. 5A-5C and accordingly, it is possible to further reduce damage of the electron emission elements or the like. Moreover, in like FIG. 3, in FIGS. 6A and 6B, no metal back is present in the concave portions 123. Accordingly, even when the spacers 30 are inserted in the concave portions 123, there is no danger of scattering of metal back fine powder. It should be noted that 131F and 131G are openings surrounded by a plurality of separate metal backs 130F and 130G where the metal sheet 120 is exposed.

The metal back 130 described in FIG. 3 to FIGS. 6A and 6B can easily be formed by the conventional vacuum deposition (known technique) of aluminum (Al) by using a metal mask. Moreover, it is also possible to form the metal back 130 by the printing method using metal paste (such as silver paste). It should be noted that after the fluorescent material is painted, filming processing is performed, and then the metal back is formed by the aluminum vacuum deposition or silver paste printing.

As described above, according to this embodiments, the metal sheet 120 used has a plurality of fine holes 122 having the fluorescent material 111 and the black oxide film formed as the light absorbing layer 121 on the side of the light transparent substrate 111. The metal sheet also has a plurality of concave portions 123 formed on the side of the rear panel 1. The metal back 130 having an opening corresponding to a predetermined area surrounding the concave portions 123 is superimposed on the metal sheet 120, thereby constituting an acceleration electrode of two-layer structure. By inserting spacers 30 into the concave portions 123 of the metal sheet 120 exposed in the openings 131 of the metal back 130, it is possible to prevent charging of the spacers 30 without lowering the contrast. Furthermore, it is possible to easily assemble the spacers 30 with a high accuracy al at once while suppressing the positioning shift. Moreover, since no metal back is formed in the area surrounding the concave portions 123 of the metal sheet 120, even when the spacers 30 are inserted into the concave portions 123, there is no danger of scratching the metal back. Accordingly, it is possible to prevent scattering of metal back fine powder caused by friction and there is no danger of shortcircuit of the electron emission elements and a wiring circuit of the rear panel 1. It should be noted that even when the spacer 30 scratches the metal sheet 120, the metal sheet 120 is made of extremely low carbon steel thin plate of Fe—Ni-based alloy and there is no danger of generation of metal fine powder.

In this embodiments thus described, fixing member is applied to the light transparent substrate 110 when fixing the metal sheet 120 obtained by blackening the extremely low carbon steel thin plate of Fe—Ni-based alloy to the light transparent substrate 110. However, this invention is not limited to this. For example it is possible to paint a fixing member mixed with black pigment so as to be black onto the metal sheet 120 not subjected to the blackening processing and fix the light transparent substrate 110. That is, glass paste and black pigment paste containing black pigment are printed on the metal sheet 120 excluding the fine holes 122 and the light transparent substrate is fixed. Here, the light absorbing layer is simultaneously formed. In this case, since the metal sheet 120 is not subjected to the blackening processing, it is possible to skip the step of removing the black oxide film from the inner wall of the fine holes 122 of the metal sheet 120 and the surface where the metal back is to be formed (such as sand blast). It is noted that fine irregularities should be formed on the inner wall of the fine holes 122 for improving wettability.

Thus, according to this invention, it is possible to prevent interference (friction) between the spacers and the metal back when attaching the spacers to the display panel. Accordingly, it is possible to prevent shortcircuit of the electron emission elements and a wiring circuit of the rear panel. Moreover, the spacers are not brought into direct contact with the metal back and it is possible to suppress charge of spacers. Furthermore, according to this invention, it is possible to attach the spacers with a high accuracy while suppressing positioning shift. The spacers can be easily attached at once. As a result, according to this invention, it is possible to improve the reliability and/or productivity of the flat-type display device such as the FED.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A display device comprising:

(a) a rear substrate including an insulative substrate on which a plurality of cold cathode elements for emitting electrons are formed;

(b) a display substrate including:

a light transparent substrate arranged to oppose to said rear substrate;

a metal sheet including a plurality of fine holes arranged in a matrix and each having a plurality of fluorescent materials excited by an electron beam from the cold cathode element so as to emit light;

a metal back arranged at the side of the rear substrate of the metal sheet, to which metal back acceleration voltage is applied for accelerating the electron beam from the cold cathode element;

(c) a plurality of support members arranged vertically between said rear substrate and said display substrate so as to maintain the interval between them; and (d) a frame member;

wherein a space surrounded by said rear substrate, said display substrate and said frame member is a vacuum atmosphere;

wherein said metal sheet includes a light absorbing layer for absorbing external light formed on a surface of the light transparent substrate side a plurality of concave portions for holding said support members on the surface of said rear substrate side;

wherein said metal back has an opening formed to exposes a predetermined area at least around the concave portion of said metal sheet; and wherein said display substrate has a fixation layer for fixing said metal sheet to the light transparent substrate.

2. A display device as claimed in claim 1, wherein said metal back is separately formed only on the area including at least one fine hole of said metal sheet.

3. A display device as claimed in claim 1, wherein each of the fine holes emits light of one of three light primary colors, three of the fine holes emitting the colors constitute one pixel, and said metal back is separately formed only on the area containing at least one of the pixels.

4. A display device as claimed in claim 1, wherein said metal sheet is fixed to the light transparent substrate by the fixation layer, after which the fine holes are formed on said metal sheet.

5. A display device as claimed in claim 1, wherein the fixation layer is a glass layer having a low melting point.

6. A display device as claimed in claim 5, wherein the fixation layer is a glass layer having a light transparency limited to a predetermined value.

7. A display device as claimed in claim 5, wherein said metal sheet, the light transparent substrate and the glass layer have substantially same thermal expansion coefficient.

8. A display device as claimed in claim 1, wherein said metal sheet has a thickness of 20 μm to 250 μm.

9. A display device as claimed in claim 1, wherein said metal sheet has a composition of Fe—Ni-based alloy.

10. A display device as claimed in claim 1, wherein said metal sheet has a substantially black surface on the light transparent substrate side.

11. A display device as claimed in claim 1, wherein the side wall of the fine holes formed on said metal sheet is electrically conductive.

12. A display device as claimed in claim 1, wherein the fluorescent materials in the fine holes of said metal sheet has a substantially U-shaped cross sectional view.

* * * * *